United States Patent [19]

Li

[11] Patent Number: 4,706,829

[45] Date of Patent: Nov. 17, 1987

[54] LIQUID CONTAINING AND DISPENSING PACKAGE

[75] Inventor: Ernest L. Li, Toledo, Ohio

[73] Assignee: Owens-Illinois Closure Inc., Toledo, Ohio

[21] Appl. No.: 827,299

[22] Filed: Feb. 7, 1986

[51] Int. Cl.[4] ..... B65D 41/00

[52] U.S. Cl. ..... 215/354; 222/569; 222/570; 222/461; 220/288; 220/306

[58] Field of Search ..... 215/343-345, 215/307, 341, 384; 220/288, 306; 222/461, 542, 566, 567, 569, 570

[56] References Cited

U.S. PATENT DOCUMENTS

| | | | |
|---|---|---|---|
| 2,763,402 | 9/1956 | Livingstone | 222/570 |
| 2,763,403 | 9/1956 | Livingstone | 222/570 |
| 3,240,404 | 3/1966 | Porter et al. | 222/570 |
| 3,297,184 | 1/1967 | Andelin | 215/307 |
| 3,339,772 | 9/1967 | Miller | 215/307 |
| 3,563,422 | 2/1971 | Cruikshank | 222/570 |
| 4,133,462 | 1/1979 | Lindstrom | 215/307 |
| 4,253,459 | 3/1981 | Willis | 215/341 |
| 4,261,475 | 4/1981 | Babiol | 215/341 |
| 4,264,022 | 4/1981 | Perné et al. | 222/570 |

*Primary Examiner*—Joseph Man-Fu Moy
*Attorney, Agent, or Firm*—H. G. Bruss

[57] ABSTRACT

A liquid containing and dispensing package comprising a hollow plastic container having a neck, a fitment interengaging the neck and closure. The fitment interengages the neck and has a first peripheral portion extending axially and having a portion defining a spout having a pouring lip extending axially inwardly of the end of the neck, and a closure comprising a top wall and a first peripheral wall extending from the top wall axially inwardly. The closure includes a radial portion extending from the peripheral wall and sealingly engaging an annular area of the fitment. The closure defines a dispensing cup and includes a second outer peripheral wall spaced from the first peripheral wall which has internal threads engaging external threads on the neck of the container.

16 Claims, 3 Drawing Figures

LIQUID CONTAINING AND DISPENSING PACKAGE

This invention relates to liquid containing and dispensing packages and particularly to such packages which include a pouring spout and a closure that functions as a measuring cup.

BACKGROUND AND SUMMARY OF THE INVENTION

In one type of liquid dispensing package, a pouring spout fitment is positioned on the neck of the container and a closure in the form of the cup is interengaged with the periphery of the container. More specifically, a spout is mounted in a first fitment that snaps onto a container. The fitment has internal threads which are engaged by the external threads of a cover.

Among the problems heretofore encountered in connection with such package are that it is difficult to provide a seal between the fitment forming the pouring lip and the container, and necessitates increasing the height of the package to increase the capacity of the closure as a cup and requires the closure to have substantial height above the neck of the container in order to provide the necessary capacity for measuring the liquid delivered to the cup in use.

In accordance with the invention, a liquid containing and dispensing package comprising a hollow plastic container having a neck, a fitment interengaging the neck and a closure. The fitment interengages the neck and as a first peripheral portion extending axially and having a portion defining a spout having a pouring lip extending axially inwardly of the end of the neck, and a closure comprising a top wall and a first peripheral wall extending from the top wall axially inwardly. The closure includes a radial portion extending from the peripheral wall and sealingly engaging an annular area of the fitment. The closure defines a dispensing cup and includes a second outer peripheral wall spaced from the first peripheral wall which has internal threads engaging external threads on the neck of the container.

DESCRIPTION

Figure 1:
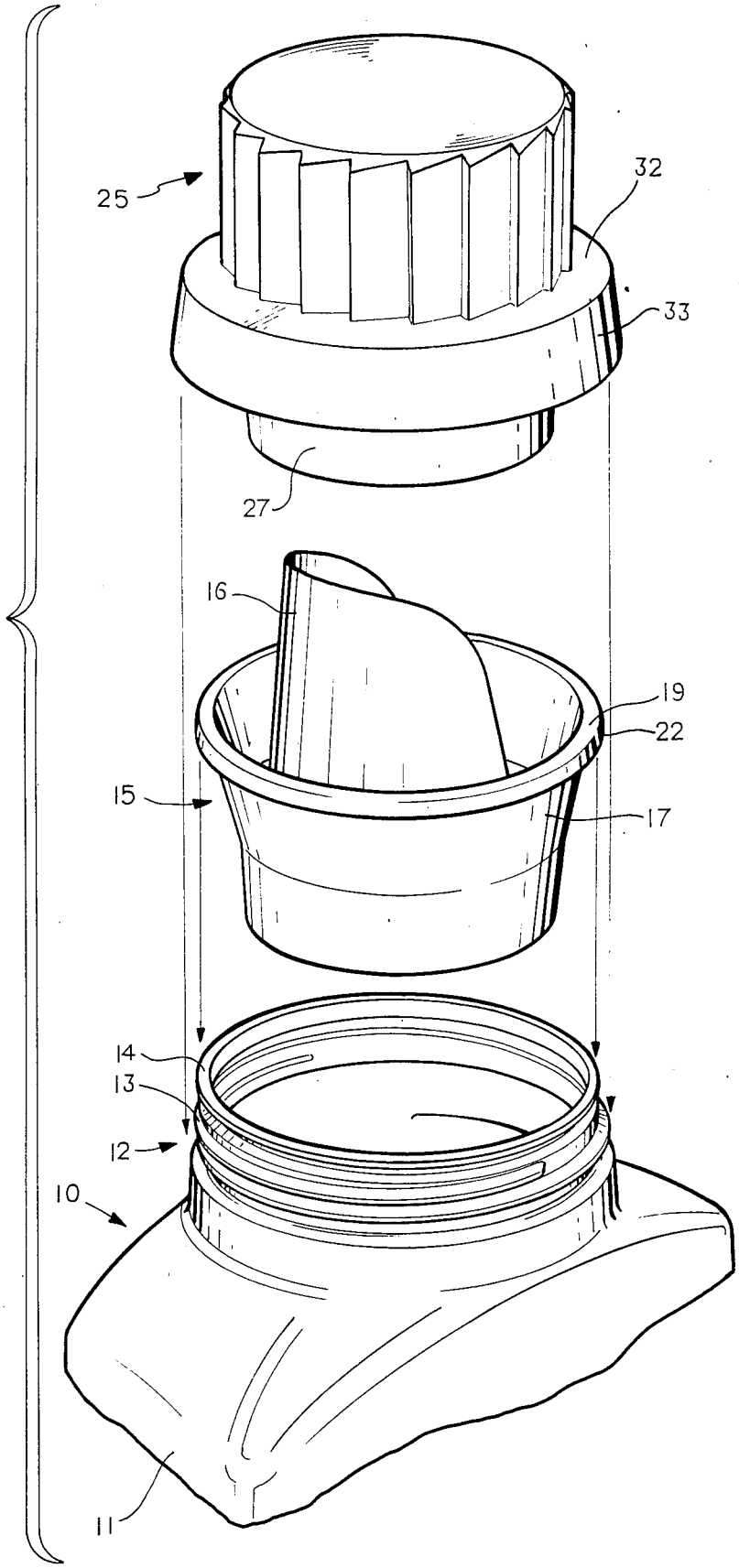
FIG. 1 is an exploded view of the package embodying the invention.
Figure 2:
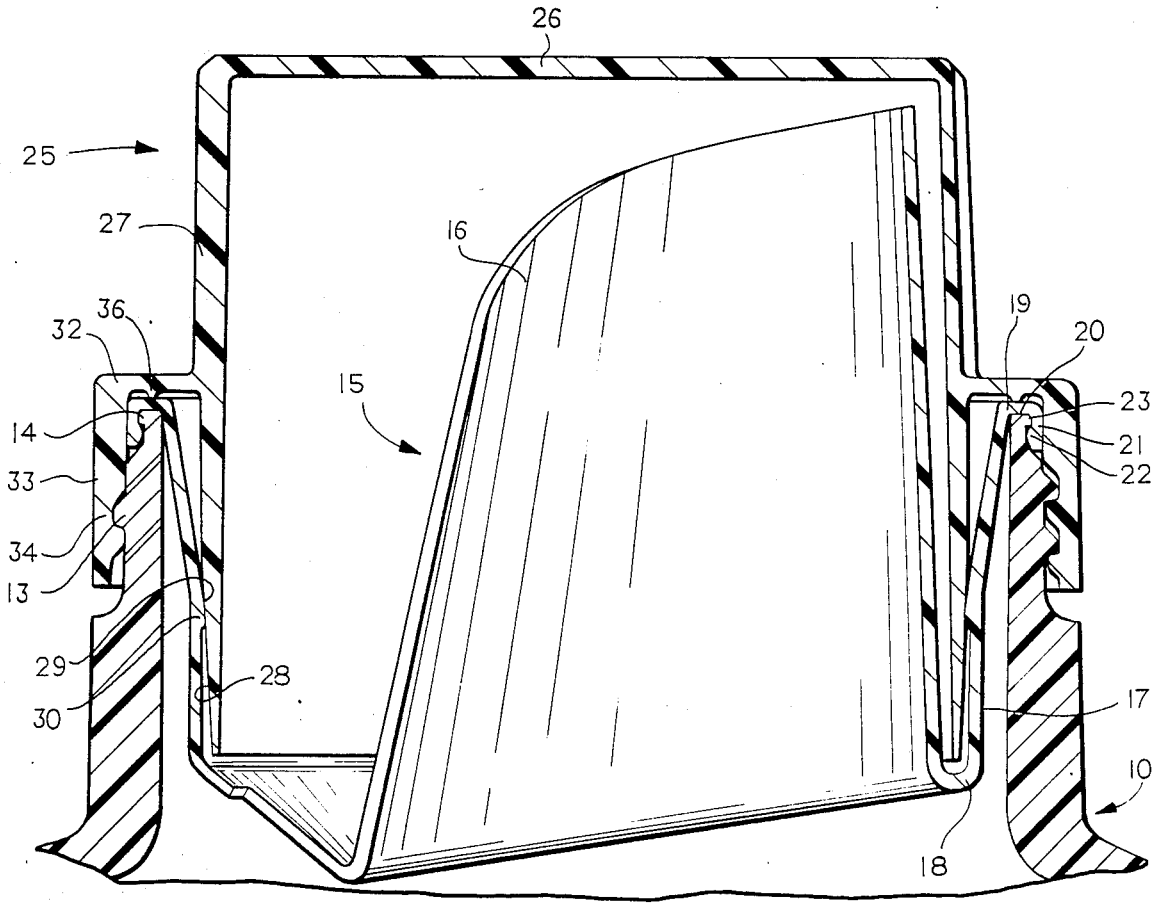
FIG. 2 is a longitudinal sectional view of the package.

In accordance with the invention, the container 10 comprises a hollow plastic container having a body 11 and a neck 12. The neck 12 is formed with external threads 13 and a radially outwardly extending peripheral bead 14 adjacent the upper end. The package further includes a fitment 15 that comprises a centrally disposed inner portion defining a pouring lip 16 that is arcuate in transverse cross-section and an outer wall portion 17 interconnected by an annular portion 18 and extending generally upwardly and outwardly. The outer wall portion 17 further includes a peripheral flange 19 adapted to engage the upper surface 20 of the neck of the container and an integral downwardly extending peripheral wall 21 having an inwardly extending annular bead 22 that snaps over an external annular bead 23 on the flange 19 of the container.

The package further includes a closure 25 that is generally cylindrical including a top wall 26 and a peripheral wall 27. The peripheral wall extends downwardly within the walls of the spout and includes an inwardly extending tapered surface 28 that sealingly engages the inner surface 29 of the outer wall 17. An annular bead 30 on the peripheral wall portion 17 sealingly engages the outer surface of wall 27. Alternatively, the bead may be on the wall 27. The cap 25 further includes an annular wall 32 extending radially outwardly intermediate the ends of the peripheral wall 27 and an annular axial skirt 33 extending downwardly and having internal threads 34 engaging the external threads 13 on the neck 12.

The annular wall 32 of the closure includes an annular downwardly extending annular projection in the form of a bead 35, preferably having a V cross-section, that engages the annular wall 19 on the fitment to provide a primary seal between the closure 25 and the fitment 15 and, in turn, force the wall 19 of the fitment 15 against the end of the neck.

The container 10 may be made of plastic material such as high density polyethylene. The fitment 15 may be made of plastic material such as low density polyethylene and the closure 25 may be made of plastic material such as polypropylene.

Figure 3:
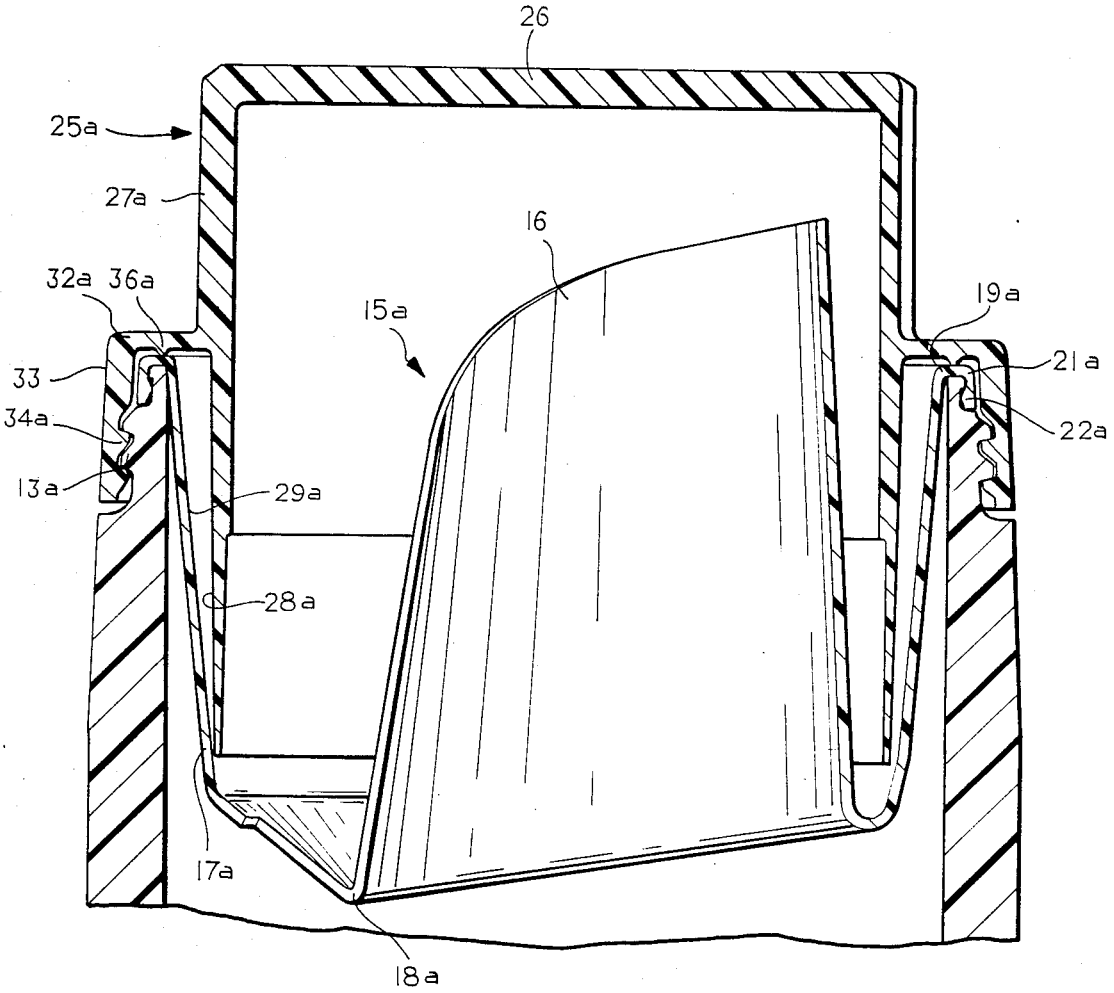
FIG. 3 is a longitudinal sectional view of a modified form of the package.

In the modified form shown in FIG. 3, the structure is the same except that bead 30 is eliminated and the resultant secondary seal is eliminated. In all other respects, the construction is the same and the corresponding parts are designated with the same reference numerals with the suffix "a". The wall **27*a* is thus spaced from the wall 17*a***.

The interior of wall 27 of the closure is formed with a step or shoulder 31 at the desired position such that the closure can be used as a cup to measure a predetermined quantity of the liquid contents.

When it is necessary to change the capacity of the closure functioning as a dispensing cup, the fitment can be made shorter or longer in its axial extent within the container and the peripheral wall of the cup below wall 32 may similarly be made shorter or longer. In each instance, the portion of the cup above the annular flange remains the same and the overall height of the package does not change. As a result, the closure can have a more conventional appearance.

It can thus be seen that the invention comprises separate seal areas one or both of which may be used, the fitment can be made simpler since it does not have any threads, the overall design and appearance of the package is more aesthetically simple and pleasing; the construction permits ready assembling of the components; the package can be filled even after the fitment has been positioned; and the capacity of the cup can be changed without varying the height of the package; and the design of the closure is simplified reducing the cost.

I claim:

1. A liquid containing and dispensing package comprising a hollow plastic container having a neck with external threads thereon, a fitment, snap-on interengaging means between the fitment and the neck, said fitment having an inner wall defining a pouring lip extending from within the neck axially beyond the interengaging means and beyond the end of the neck, said fitment including an outer annular wall connected to the inner wall by an annular portion at the end of the inner wall of the fitment within the neck, said outer annular wall of said fitment extending from the end of the inner wall within the neck and terminating at said interengaging means, said annular connecting portion of said fitment having a drain opening therethrough, said outer wall of said fitment having an inner surface, a cup-shaped closure comprising a top wall and a peripheral wall extending from the top wall, said peripheral wall of said closure extending axially inwardly between the inner wall and the outer wall of the fitment to a point adjacent the lower ends of said inner wall and said outer wall, said peripheral wall of said closure being spaced from the inner wall of the closure, said closure including an outer radially outwardly extending annular wall which is connected to the peripheral wall of the closure intermediate the ends of said peripheral wall, said closure including an outer axially extending skirt connected to said radial wall of said closure and is spaced from said peripheral wall, said annular skirt having internal threads engaging external threads on the neck of the container, said fitment having a peripheral radial flange extending outwardly from the upper edge of said outer wall of said fitment overlying and engaging the upper end of the neck of the container, said radial wall of said closure overlying said radial flange of said fitment, means between said peripheral flange of said fitment and the upper end of said neck of said container defining a seal, and means between said radial wall of said closure and said radial flange of said fitment defining a seal.

2. The package set forth in claim 1 wherein said peripheral wall of said closure has an outer surface sealingly engaging the outer annular wall of the fitment.

3. The package set forth in claim 2 including an interengaging bead on one of said peripheral wall of the closure and the outer wall of the fitment.

4. The package set forth in claim 3 wherein said bead is on the outer wall of the fitment.

5. The package set forth in claim 1 wherein said interengaging means between said fitment and said container comprises a peripheral wall on said radial flange of said fitment, said neck of said container having an external peripheral bead, said peripheral wall on said flange having an internal bead engaging said external bead on said container.

6. The package set forth in claim 5 wherein said means defining a seal between the radial flange of the fitment and neck of the container comprises a downwardly extending bead on said radial flange of said fitment engaging the neck of the container.

7. The package set forth in claim 6 wherein said means defining a seal between the radial wall of the closure and said radial flange of said fitment comprises an annular bead on said radial wall of said closure engaging said radial flange of said fitment.

8. A liquid containing and dispensing package comprising a hollow plastic container having a neck with external threads thereon, a fitment, said fitment having an inner wall defining a pouring lip extending from within the neck axially beyond the interengaging means and beyond the end of the neck, said fitment including an outer annular wall connected to the inner wall by an annular portion at the end of the inner wall of the fitment within the neck, said outer annular wall of said fitment extending from the end of the inner wall within the neck and terminating at said interengaging means, said annular connecting portion of said fitment having a drain opening therethrough, said outer wall of said fitment having an inner surface, a cup-shaped closure comprising a top wall and a peripheral wall extending from the top wall, said peripheral wall of said closure extending axially inwardly between the inner wall and the outer wall of the fitment to a point adjacent the lower ends of said inner wall and said outer wall, said peripheral wall of said closure being spaced from the inner wall of the closure, said closure including an outer radially outwardly extending annular wall which is connected to the peripheral wall of the closure intermediate the ends of said peripheral wall, said closure including an outer axially extending skirt connected to said radial wall of said closure and is spaced from said peripheral wall, said annular skirt having internal threads engaging external threads on the neck of the container, snap-on interengaging means between said fitment and said container comprising a peripheral wall on said radial flange of said fitment, said neck of said container having an external peripheral bead, said peripheral wall on said flange having an internal bead engaging said external bead on said container, said fitment having a peripheral radial flange extending outwardly from the upper edge of said outer wall of said fitment overlying and engaging the upper end of the neck of the container, said radial wall of said closure overlying said radial flange of said fitment, means between said peripheral flange of said fitment and the upper end of said neck of said container defining a seal, a downwardly extending bead on said radial flange of said fitment engaging the neck of the container, means between said radial wall of said closure and said radial flange of said fitment defining a seal, an annular bead on said radial wall of said closure engaging said radial flange of said fitment.

9. A liquid containing and dispensing closure and fitment for use in a package comprising a hollow plastic container having a neck with threaded external threads, a fitment, snap-on interengaging means on said fitment adapted to engage the neck of a container, said fitment having an inner wall defining a pouring lip adapted to extend from within the neck of the container axially beyond the end of the neck, said fitment including an outer annular wall connected to the inner wall by an annular portion at the end of the inner wall of the fitment which is adapted to be within the neck of the container, said outer annular wall of said fitment adapted to extend from the end of the inner wall within the neck and terminating at said interengaging means, said annular connecting portion of said fitment having a drain opening therethrough, said outer wall of said fitment having an inner surface, a cup-shaped closure comprising a top wall and a peripheral wall extending from the top wall, said peripheral wall of said closure extending axially inwardly between the inner wall and the outer wall of the fitment to a point adjacent the lower ends of said inner wall and said outer wall, said peripheral wall of said closure being spaced from the inner wall of the closure, said closure including an outer radially outwardly extending annular wall which is connected to the peripheral wall of the closure intermediate the ends of said peripheral wall, said closure including an outer axially extending skirt connected to said radial wall of said closure and is spaced from said peripheral wall, said annular skirt having internal threads adapted to engage external threads on the neck of the container, said fitment having a peripheral radial flange extending outwardly from the upper edge of said outer wall of said fitment adapted to overlie the upper end of the neck of the container, means on said peripheral flange of said fitment adapted to engage the neck neck of the container to define a seal, and means between said radial wall of said closure and said radial flange of said fitment defining a seal.

10. The closure and fitment set forth in claim 9 wherein said peripheral wall of said closure has an outer surface sealingly engaging the outer annular wall of the fitment.

11. The closure and fitment set forth in claim 10 including an interengaging bead on one of said peripheral wall of the closure and the outer wall of the fitment.

12. The closure and fitment set forth in claim 11 wherein said bead is on the outer wall of the fitment.

13. The closure and fitment set forth in claim 9 wherein said interengaging means between said fitment and container comprises a peripheral wall in said radial flange, said peripheral wall on said flange having an internal bead adapted to engage an external bead on a container.

14. The closure and fitment set forth in claim 13 wherein said means defining a seal between the radial flange of the fitment and neck of the container comprises a downwardly extending bead adapted to engage the neck of the container to form said sealing means between said fitment and said container.

15. The closure and fitment set forth in claim 14 wherein said means defining a seal between the radial wall of the closure and said radial flange of said fitment comprises an annular bead on said radial wall of said closure engaging said annular flange of said fitment.

16. A liquid containing and dispensing closure and fitment for use in a package comprising a hollow plastic container having a neck with threaded external threads, a fitment, said fitment having an inner wall defining a pouring lip adapted to extend from within the neck of the container axially beyond the end of the neck, said fitment including an outer annular wall connected to the inner wall by an annular portion at the end of the inner wall of the fitment which is adapted to be within the neck of the container, said outer annular wall of said fitment adapted to extend from the end of the inner wall within the neck and terminating at said interengaging means, said annular connecting portion of said fitment having a drain opening therethrough, said outer wall of said fitment having an inner surface, a cup-shaped closure comprising a top wall and a peripheral wall extending from the top wall, said peripheral wall of said closure extending axially inwardly between the inner wall and the outer wall of the fitment to a point adjacent the lower ends of said inner wall and said outer wall, said peripheral wall of said closure being spaced from the inner wall of the closure, said closure including an outer radially outwardly extending annular wall which is connected to the peripheral wall of the closure intermediate the ends of said peripheral wall, said closure including an outer axially extending skirt connected to said radial wall of said closure and is spaced from said peripheral wall, said annular skirt having internal threads adapted to engage external threads on the neck of the container, snap-on interengaging means on said fitment comprising a peripheral wall on said radial flange, said peripheral wall on said flange having an internal bead adapted to engage an external bead on the container, said fitment having a peripheral radial flange extending outwardly from the upper edge of said outer wall of said fitment adapted to overlie the upper end of the neck of the container, means on said peripheral flange of said fitment adapted to engage the neck neck of the container to define a seal, a downwardly extending bead adapted to engage the neck of the container, and means between said radial wall of said closure and said radial flange of said fitment defining a seal, an annular bead on said radial wall of said closure engaging said radial flange of said fitment.

* * * * *